United States Patent [19]

Carlberg

[11] 4,415,193

[45] Nov. 15, 1983

[54] SLIP SETTING RING

[75] Inventor: Charles E. Carlberg, Houston, Tex.

[73] Assignee: Hughes Tool Company, Houston, Tex.

[21] Appl. No.: 239,308

[22] Filed: Feb. 27, 1981

[51] Int. Cl.[3] ..... A44B 21/00

[52] U.S. Cl. ..... 294/102 A

[58] Field of Search ..... 294/102 A, 102 R, 106, 294/91, 90, 110; 414/22; 24/263 D, 263 DC, 263 DA, 263 DT, 263 SB, 263 DP

[56] References Cited

U.S. PATENT DOCUMENTS 3,032,366 5/1962 Meek ..... 294/102 A 4,275,488 6/1981 Gray ..... 294/102 A

OTHER PUBLICATIONS

BJ-Hughes Inc., Composite Catalogue—1978-1979, "Oil Field Products & Systems", pp. 26, 29.

*Primary Examiner*—James B. Marbert

*Attorney, Agent, or Firm*—Robert A. Felsman; Charles D. Gunter, Jr.

[57] ABSTRACT

An improved slip-setting ring for slip-type derrick elevators has spring-biased sliding inserts which are located in oppositely facing slots in the slip-setting ring. The sliding inserts are spring-biased inwardly toward the pipe receiving opening in the ring but slide outwardly upon contacting the upset portion of a pipe thereby reducing the wedging action of the pipe within the pipe receiving opening.

7 Claims, 4 Drawing Figures

SLIP SETTING RING

BACKGROUND OF THE INVENTION

The present invention relates generally to derrick hoisting equipment and particularly to slip type derrick elevators which grip and support pipe, tubing, and casing when running into or out of the well bore.

During drilling operations, it is necessary to periodically remove the string of drill pipe from the well bore. The drill string is separated into sections or stands of pipe from 60 to 90 feet in length and the stands are racked in an upright position in the derrick. The typical elevator has two body sections which are pivotally attached to open and close about the pipe. Ears are provided on the elevator to support the same by means of links which are attached to the hook and traveling block. When the two body sections of the elevator are latched into position about the pipe, the top surface of the elevator forms a shoulder upon which the pipe external upset rests. By raising the elevator, the stand of pipe can be maneuvered into position on the derrick.

Slip type elevators are customarily used with casing and tubing which have less pronounced upsets than drill pipe. The slips of a slip type elevator support the tubing or casing by a wedging action of the slips between the tubing or casing and the tapered surface of the elevator bowl. The slips are forced into contact with the tubing or casing by contact of the external upset onto the top of a disk-shaped plate commonly referred to as the slip setting ring. The slip setting ring, in turn, contacts the top of the slips and forces them down in the tapered bowl of the elevator. As the slips move downward in the bowl, the tapered surface causes the slips to move radially inward to contact the tubing or casing. Slip-type elevators utilizing slip setting rings are shown, for instance, on page 26 of the BJ-HUGHES Inc. 1978–79, Composite Catalogue, entitled "Oilfield Products and Systems."

A recurring problem in the use of slip-type derrick elevators is the binding of the slip setting ring on the taper of the upset of the pipe, tubing, or casing during setting of the slips. This problem is especially distressing when coming out of the well bore since the derrick man must attempt to "unstick" the slip setting ring. Attempts have been made to provide slip-type elevators with modified bowl configurations in order to alleviate the problem. However, when worn, these slip setting rings also stick. Other designs have embodied a molded rubber insert bonded to the inner surface of the setting ring but have similarily been unsuccessful in preventing sticking.

SUMMARY OF THE INVENTION

The present invention is an improved slip setting ring for slip-type derrick elevators of the type having a tapered bowl with a central bore adapted to receive pipe and having a plurality of pipe gripping slips slidably mounted in the bowl for movement between an upward pipe receiving position and a downward pipe gripping position. A setting ring is selectively positioned with respect to the slips in the bowl so that downward movement of the ring causes movement of the slips from the pipe receiving to the pipe gripping position. The setting ring has a pipe receiving opening concentrically aligned with the central bore of the elevator and has a pair of oppositely facing recesses which are transversely aligned with the pipe receiving opening. A pair of matching inserts are slidably received within the oppositely facing recesses. Biasing means urge the inserts inwardly toward the pipe receiving opening for contacting the pipe.

In the preferred embodiment, the setting ring is a disk-shaped plate having an arcuate pipe receiving opening and a pipe receiving lateral passage extending outwardly from the pipe receiving opening. The oppositely facing recesses are dovetail slots having grooves formed therein and are adapted to slidably receive a set of matching inserts. Each insert has an upper surface and a lower surface, the lower surface having a spring-containing cavity. A spring located in each spring-containing cavity and resting in the grooved slots urges the inserts inwardly toward the pipe receiving opening. A plug intersects each grooved slot to limit movement of the oppositely facing inserts outwardly from the pipe receiving opening by limiting outward movement of the spring. The matching inserts are preferably reversable in the slots and have wear surfaces on either end thereof.

Additional objects, features and advantages of the invention will become apparent in the following descriptions.

DETAILED DESCRIPTION OF THE DRAWINGS

DETAILED DESCRIPTION OF THE INVENTION

Figure 1:
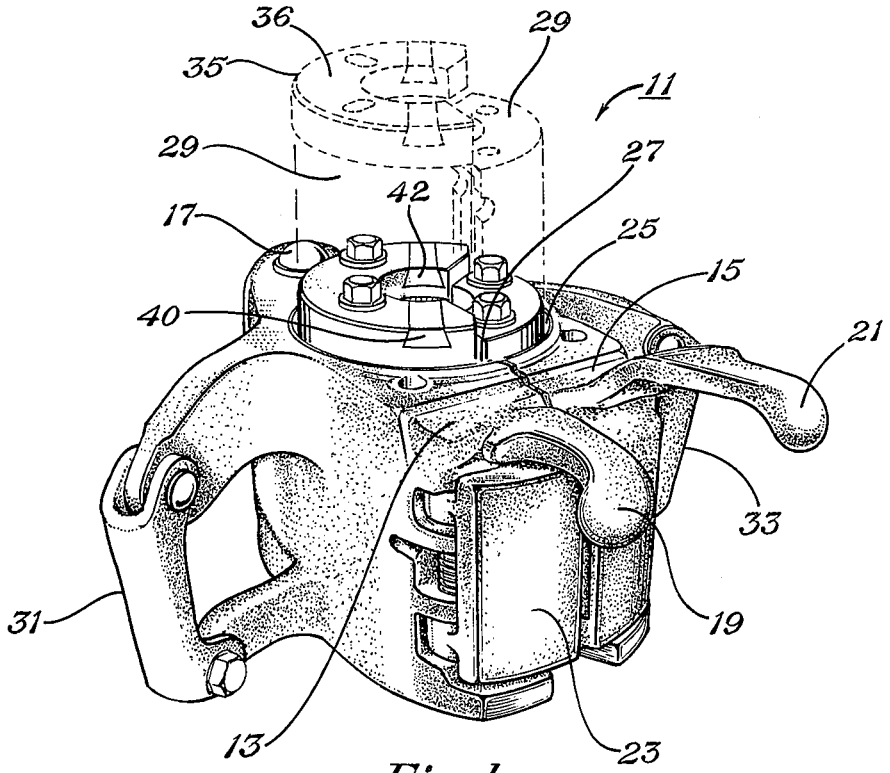
FIG. 1 is a perspective view of the improved slip setting ring in place in a slip-type derrick elevator.

Referring now to FIG. 1, the improved slip-setting ring is shown in place in a slip-type derrick elevator designated generally as 11. The elevator 11 is comprised of body sections 13, 15 which are pivotally joined at the rear 17. Handles 19, 21 and the usual latching mechanism 23 allow body sections 13, 15 to be secured about a section of pipe, tubing, or casing. For purposes of this discussion, the word "pipe" will be taken to mean pipe, tubing, or casing, it being understood that slip-type elevators are generally employed with tubing or casing but could also be employed with drill pipe. Elevator 11 also has a tapered bowl 25 and a central bore 27 adapted to receive a pipe. A plurality of pipe gripping slips 29 are slidably mounted in the bowl for movement between an upward pipe receiving position (shown in dotted lines in FIG. 1) and a downward pipe gripping position as shown in FIG. 1. The elevator ears 31, 33 are provided to support the elevator by means of links (not shown) which are attached to the hook and traveling block.

Figure 2:
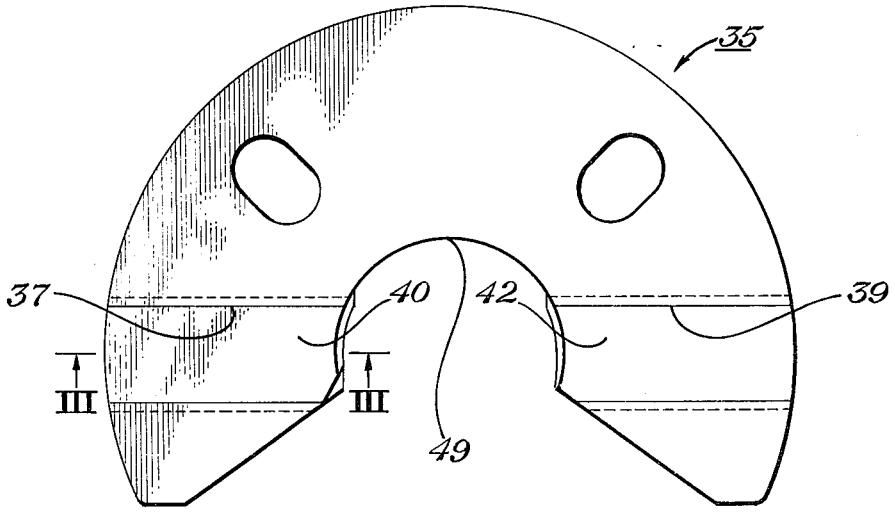
FIG. 2 is a top view of the slip setting ring.

The improved slip-setting ring 35 is shown selectively positioned with respect to the slips 29 in FIG. 1 so that downward movement of the ring 35 causes movement of the slips 29 from the pipe receiving to the pipe gripping position. As shown in FIG. 2, the slip setting ring 35 is preferably a disk-shaped ring having a pipe receiving opening 49 and a pair of oppositely facing recesses 37, 39 into which are fitted matching inserts 40, 42.

Figure 3:
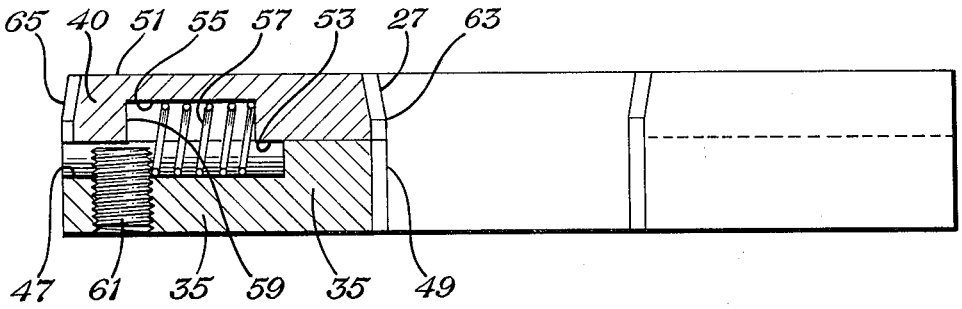
FIG. 3 is a sectional view of the slip setting ring of FIG. 2 taken along lines III—III.
Figure 4:
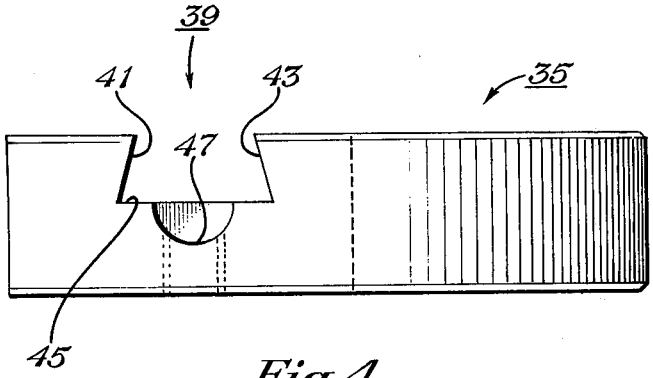
FIG. 4 is a side view of the slip setting ring of FIG. 2 showing the grooved slot.

As shown in FIG. 4, recesses 37, 39 are preferably dovetail slots having inclined sidewalls 41, 43 which form an acute angle with bottom surface 45. Bottom surface 45, as shown in FIG. 4, is provided with a semi-spherical groove 47 which runs approximately ¾ of the length of the slot 39 beginning at the end thereof distal pipe receiving opening 49. Pipe receiving opening 49 in ring 35 is an arcuate bore which is concentrically aligned with respect to central bore 27 in elevator 11 when ring 35 is mounted on top of slips 29 in elevator bowl 25. A lateral passageway extends outwardly from pipe receiving opening 49. Inserts 40, 42 as shown in FIGS. 2 and 3 are matching elongated bars which are adapted to be slidably received within recesses 37, 39. Each insert, as shown in FIG. 3, has an upper surface 51, a lower surface 53, and a spring containing cavity 55 formed in the lower surface 53. The sides of inserts, 40, 42, are suitably tapered to match the inclined sidewalls 41, 43 of the dovetail recesses 37, 39.

A biasing means is provided for urging the inserts 40, 42 inwardly toward the pipe receiving opening 49 in ring 35. The biasing means can conveniently comprise a helical spring 57 which is located in the groove 47 in bottom surface 45 and contained within cavity 55 in lower surface 53 of the insert. As can be seen in FIG. 3, the spring 57 urges the insert 40 inwardly toward the pipe receiving opening 49. Shoulder 59 in spring containing cavity 55 contacts spring 57 limiting the inward travel of insert 40 in recess 37. A plug means such as pipe plug 61 in ring 35 intersects the groove 47 in recess 37 causing spring 57 to contact the plug and limit outward movement of the insert 40 in recess 37.

As shown in FIG. 3, inserts 40, 42 preferably have wear surfaces 63, 65 on the opposite ends thereof and are reversible in recesses 37, 39.

The operation of the improved slip-setting ring will now be described in greater detail. As shown in FIG. 1, the slip-setting ring 35 is mounted on top of the slips 29 so that the contact of the upset portion of a pipe with the wear surfaces 63, 65 of inserts 40, 42 in slip-setting ring 35 causes downward movement of the slips 29 in the tapered bowl 25. Downward movement of the slips 29 in the elevator bowl 25, forces the slips 29 to contact the exterior of the pipe and wedges the pipe within the elevator bowl.

Under normal conditions, the biasing springs 57 in grooves 47 exert sufficient force on inserts 40, 42 to prevent outward movement of the inserts 40, 42 under the load of the pipe in the pipe receiving opening 49. The taper of the pipe upset contacts the inserts 40, 42 and the slip-setting ring sets the slips. There is thus no relative movement of the inserts 40, 42 in the setting ring 35. If, however, the pipe moves even slightly in the slips after they have set, a portion of the total pipe string load is transferred to the setting ring. This could cause the upset to wedge so tightly that the setting ring would stick on the pipe in the case of ordinary setting rings. The spring-biased inserts of the present slip setting ring move outwardly in recesses 37, 39 to prevent an excessive wedging load on the setting ring and thereby eliminate sticking or jamming of the pipe in the pipe receiving opening 49. The pipe plug 61 retains the spring in groove 47 and limits outward travel of the insert 40 in recess 37. Shoulder 59 in spring containing cavity 55 contacts spring 57 and limits inward travel of insert 40 in recess 37 when there is no pipe in the pipe receiving opening.

An invention has been provided with significant advantages. The improved slip-setting ring has spring biased sliding inserts which move outwardly upon contacting the upset portion of a pipe received within the bore of the elevator to prevent sticking. Operator safety is increased because the problem of unsticking elevators is eliminated. The improved slip-setting ring is simple in operation, inexpensive, and utilizes existing slip-setting ring configurations. The slidable inserts have wear surfaces on either end and are reversible for prolonged life and economy of operation.

I claim:

1. A slip setting ring for slip type derrick elevators of the type having a tapered bowl with a central bore adapted to receive pipe, said bowl having a plurality of pipe gripping slips slidably mounted in said bowl for movement between an upward pipe receiving position and a downward pipe gripping position, wherein the improvement comprises:

a setting ring selectively positioned with respect to said slips in said bowl so that downward movement of said ring causes movement of said slips from said pipe receiving to said pipe gripping position;

said setting ring having a pipe receiving opening concentrically aligned with said central bore of said elevator and having a pair of oppositely facing recesses, said recesses being transversely aligned with said pipe receiving opening;

a pair of matching inserts adapted to be slidably received within said oppositely facing recesses; and biasing means for urging said inserts inwardly toward said pipe receiving opening for contacting said pipe.

2. A slip setting ring for slip type derrick elevators of the type having a tapered bowl with a central bore adapted to receive pipe, said bowl having a plurality of pipe gripping slips slidably mounted in said bowl for movement between an upward pipe receiving position and a downward pipe gripping position, wherein the improve ment comprises:

a setting ring mounted on top of said slips in said bowl so that downward movement of said ring causes movement of said slips from said pipe receiving to said pipe gripping position;

said setting ring having a pipe receiving opening concentrically aligned with said central bore of said elevator and having a pair of oppositely facing grooved slots, said slots being transversely aligned with said pipe receiving opening;

a pair of matching inserts adapted to be slidably received within said oppositely facing grooved slots; and a spring located in each of said grooved slots, said springs urging said inserts inwardly toward said pipe receiving opening for contacting said pipe.

3. A slip setting ring for slip type derrick elevators of the type having a tapered bowl with a central bore adapted to receive pipe, said bowl having a plurality of pipe gripping slips slidably mounted in said bowl for movement between an upward pipe receiving position and a downward pipe gripping position, wherein the improvement comprises:

a disk-shaped ring mounted on top of said slips in said bowl so that downward movement of said body causes movement of said slips from said pipe receiving to said pipe gripping position;

said disk-shaped ring having a pipe receiving opening concentrically aligned with said central bore of said elevator and having a pair of oppositely facing dovetail slots having a grooved surface therein, said slots being transversely aligned with said pipe receiving opening;

a pair of matching inserts adapted to be slidably received within said oppositely facing grooved slots; and a spring located in each of said grooved slots, said springs urging said inserts inwardly toward said pipe receiving opening for contacting said pipe.

4. A slip setting ring for slip type derrick elevators of the type used to support drill pipe, comprising:

a disk-shaped ring having an arcuate pipe receiving opening and a pipe receiving lateral passage extending outwardly from said pipe receiving opening;

said disk-shaped ring having a pair of oppositely facing recesses, said recesses being transversely aligned with the vertical axis of said pipe receiving opening;

a pair of matching elongated bars adapted to be slidably received within said recesses; and biasing means for urging said bars into contact with said pipe within said pipe receiving opening.

5. A slip setting ring for slip type derrick elevators of the type used to support drill pipe, comprising:

a disk-shaped ring having an arcuate pipe receiving opening and a pipe receiving lateral passage extending outwardly from said pipe receiving opening;

said disk-shaped ring having a pair of oppositely facing grooved slots, said grooved slots being transversely aligned with the vertical axis of said pipe receiving opening;

a pair of matching elongated bars adapted to be slidably received within said grooved slots; and a spring located in each of said slots, said springs urging said bars into contact with said pipe within said pipe receiving opening.

6. A slip setting ring for slip type derrick elevators of the type used to support drill pipe, comprising:

a disk-shaped ring having an arcuate pipe receiving opening and a pipe receiving lateral passage extending outwardly from said pipe receiving opening;

said disk-shaped ring having a pair of oppositely facing grooved slots, said grooved slots being transversely aligned with the vertical axis of said pipe receiving opening;

a pair of matching elongated bars adapted to be slidably received within said grooved slots, said bars having an upper surface and a lower surface, said lower surface having a spring containing cavity;

a spring located in each of said grooved slots and contained within said spring containing cavities, said springs urging said bars into contact with said pipe within said pipe receiving opening; and plug means in said ring intersecting said grooved slots to limit movement of said bars outwardly from said pipe receiving opening.

7. The slip setting ring of claim 6, wherein said matching bars are reversible in said slots, said bars having wear surfaces on either end thereof.

* * * * *